United States Patent [19]

Curley et al.

[11] Patent Number: 4,479,463

[45] Date of Patent: Oct. 30, 1984

[54] ENGINE SUMP

[75] Inventors: Laurence D. Curley, Huntingdon; David A. Whitehead, Stamford; Rodney A. Bedborough, Westwood, all of England

[73] Assignee: Perkins Engine Group Limited, London, England

[21] Appl. No.: 467,420

[22] Filed: Feb. 17, 1983

[30] Foreign Application Priority Data

Feb. 25, 1982 [GB] United Kingdom ..... 8205586

[51] Int. Cl.[3] ..... F01M 1/12

[52] U.S. Cl. ..... 123/195 C; 123/196 CP; 123/196 R; 184/6.5; 184/106

[58] Field of Search ..... 123/195 C, 196 R, 196 A, 123/196 AB, 196 CP; 184/6.5, 106

[56] References Cited

U.S. PATENT DOCUMENTS 1,203,290 10/1916 Weiland ..... 123/196 R 3,554,322 1/1971 Deutschmann ..... 123/196 CP

FOREIGN PATENT DOCUMENTS 1123160 2/1962 Fed. Rep. of Germany ... 123/196 A

*Primary Examiner*—Craig R. Feinberg
*Assistant Examiner*—David A. Okonsky
*Attorney, Agent, or Firm*—Robert L. Farris

[57] ABSTRACT

An engine sump 4 has an oil suction passage 7 formed in its side wall to communicate with the sump well 6 at its lower end and to open upwards at its upper end to communicate with a passage in a crankcase 3. Preferably, the passage 7 opens into an upwardly opening gallery 13 in the top of the sump wall along part of its length. Two such oil suction pipes 7, 8 may be provided at opposite locations relative to a central point so that the sump 4 can be rotated 180 degrees about this point from one fitting position to another. A filter element 11 may be provided in the oil suction passage 7 and held therein by the crankcase 3.

9 Claims, 8 Drawing Figures

ENGINE SUMP

This invention relates to engine sumps.

In conventional engine sumps, oil is pumped from the sump via a suction pipe that depends from the oil pump. This has to be fitted as a separate operation during assembly of the engine and once fitted is vulnerable to vibration and may fracture.

An object of the present invention is to provide an improved means for delivering oil from the sump to the oil pump of an engine.

This object is achieved according to the invention by providing in the wall of the sump an oil suction passage that communicates with the sump at its lower end and opens upwards at its upper end to communicate with a passage in the crankcase that leads to the oil pump.

This oil suction passage is protected from damage within the wall of the sump, and is preferably formed during manufacture of the sump by being cast-in.

According to a further feature of the invention, an oil filter is provided within the oil suction passage.

According to yet a further feature of the invention, two oil suction passages are provided in the walls of the sump at opposite locations relative to a central point of the sump, as seen in plan view, so that the sump can be rotated 180 degrees about this point from one fitting position to another relative to the crankcase, a corresponding oil suction pipe communicating with the passage in the crankcase in each fitting position. This arrangement accommodates reversing of the sump to suit different engine layouts.

Figure 1:
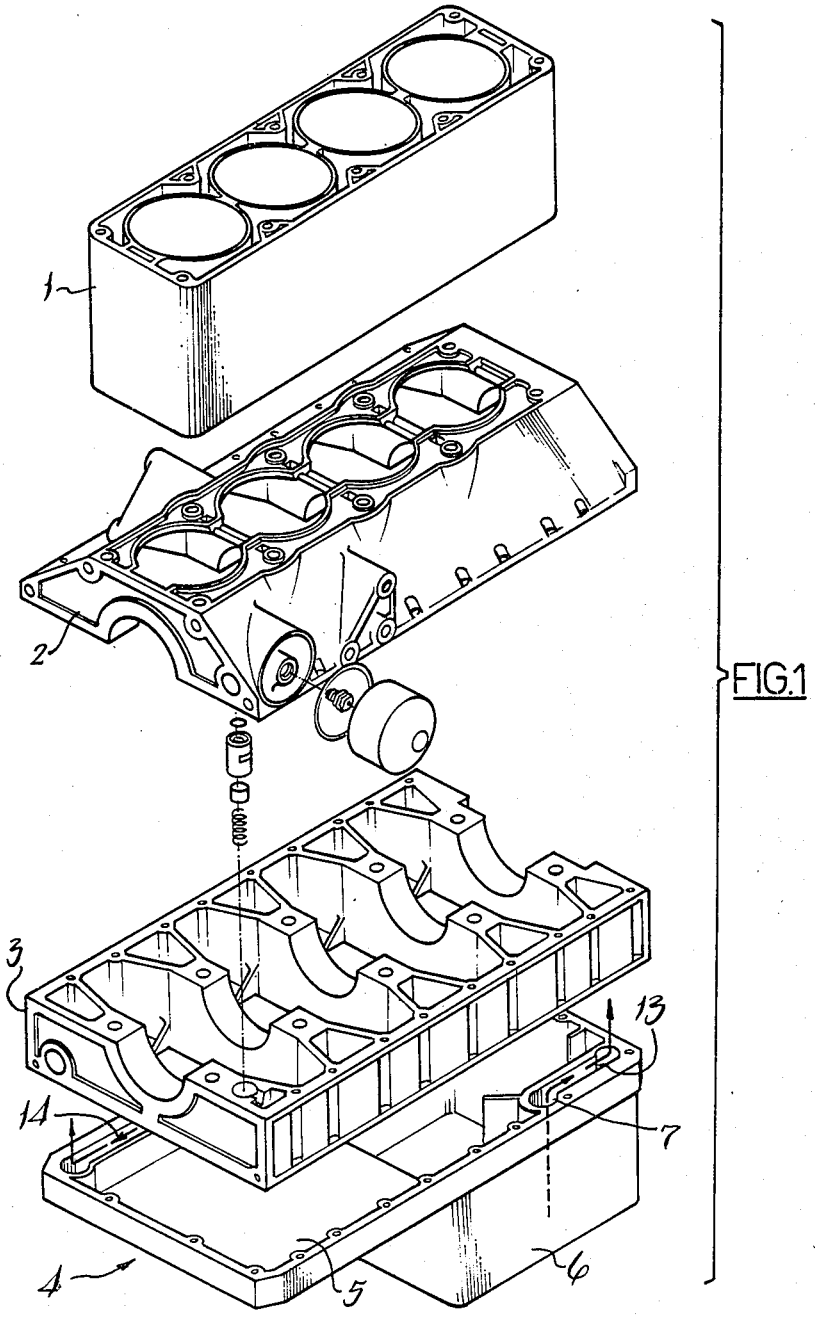
Figure 3:
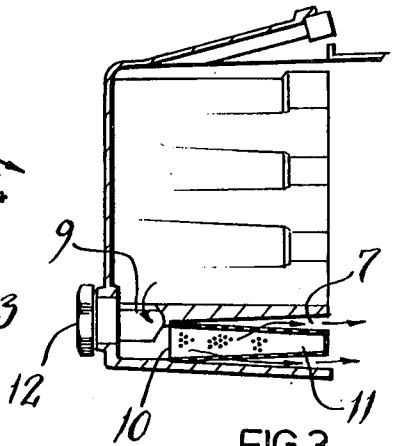
Figure 2:
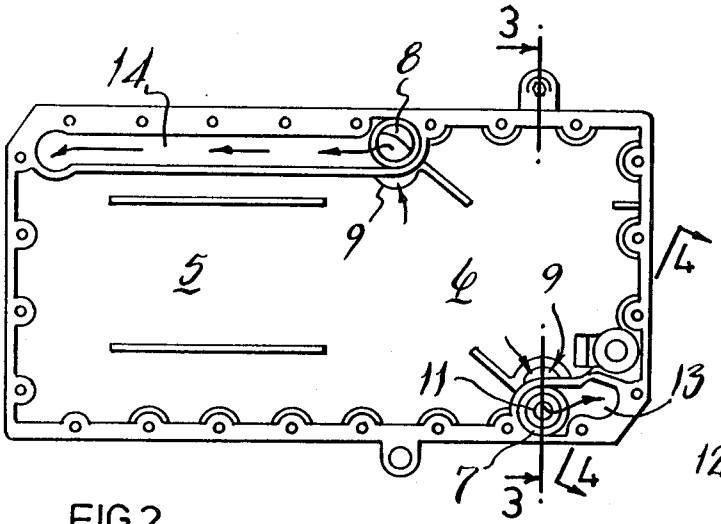
Figure 4:
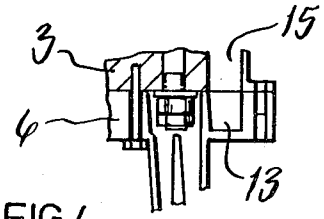
Figure 5:
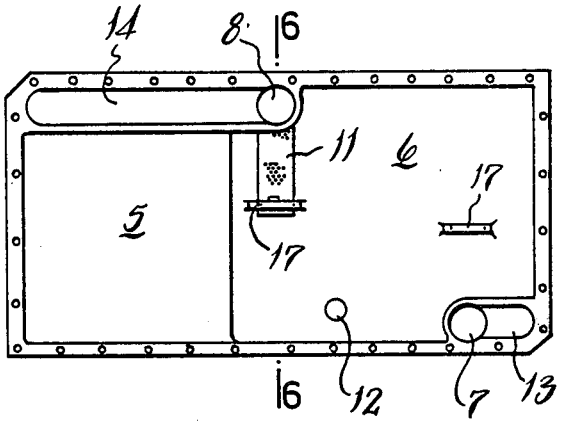
Figure 6:
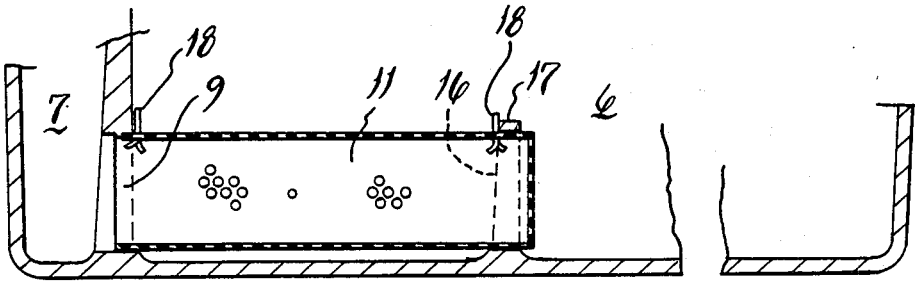
Figure 7:
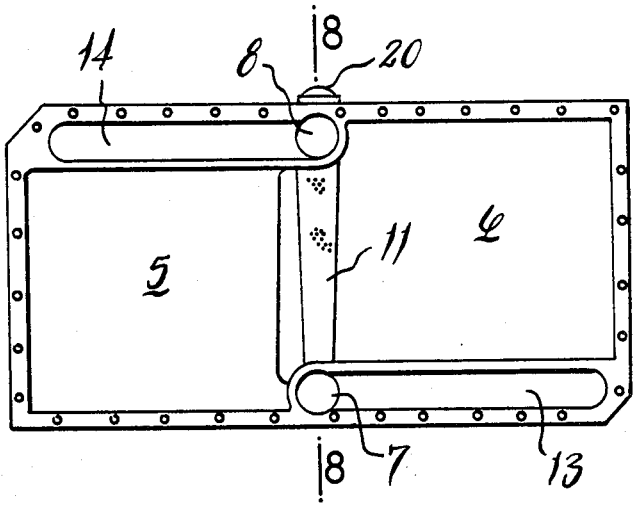
Figure 8:
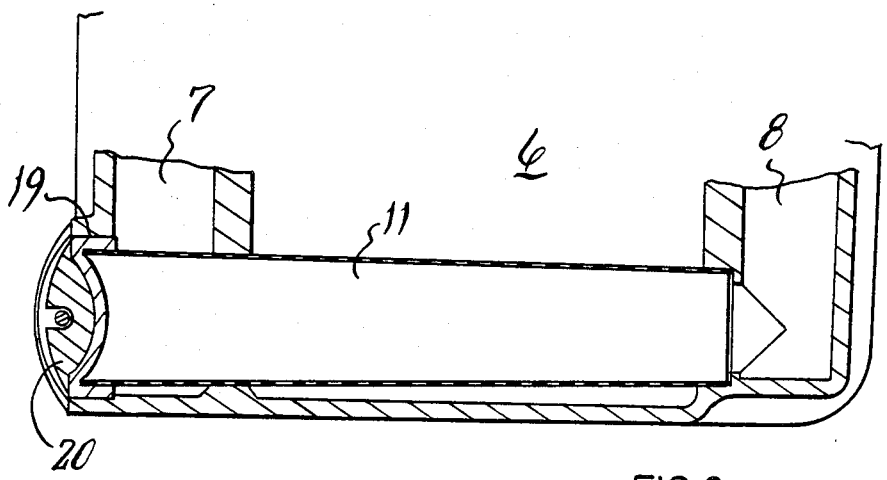

This invention will now be described by way of example with reference to the accompanying drawings in which FIG. 1 shows an exploded view of an engine including a sump and crankcase provided with oil suction passages according to the invention, FIG. 2 is a plan view of the sump of FIG. 1, FIG. 3 is a section along the line 3—3 in FIG. 2, FIG. 4 is a section along the line 4—4 in FIG. 2, FIG. 5 is a plan view of an alternative arrangement of sump and filter element according to the invention, FIG. 6 is a section along the line 6—6 in FIG. 5, FIG. 7 is a plan view of alternative arrangement of sump and filter element according to the invention, and FIG. 8 is a section along the line 8—8 in FIG. 7.

The engine shown in FIG. 1 comprises a cylinder block 1, a crankcase formed in two parts 2, 3 and a sump 4. The sump is formed as a cast component with a shallow oil collecting pan 5 at one end that delivers oil to a deeper well portion 6 at the other end. Opposite corners of the well 6 are formed with thicker walls in which vertical oil suction passages 7, 8 are formed, preferably by casting. Each passage 7, 8 opens sideways onto the floor of the well 6 through an opening 9 at its lower end. Each passage 7, 8 is of circular cross-section and tapers inwards from top to bottom and is formed with an internal shoulder 10 towards its lower end which an oil filter element 11 can be supported above the opening 9. An oil drain plug 12 is provided at the bottom of each of the passages 7, 8.

At the top of the one oil suction passage 7 near the corner of the sump, a short upwardly opening gallery 13 is formed that extends from the passage 7 into the corner of the sump. A similar but longer upwardly opening gallery 14 is formed in the opposite wall of the sump so as to extend from the top of the other oil suction passage 8 along the wall of the shallow oil collecting pan 5 to the corner of the sump diagonally opposite that of the passage 7. Each passage 7, 8 thus communicates with a corresponding diagonally opposite corner of the sump and can communicate with a passage 15 in one corner of the lower crankcase portion 3 depending on whether the sump is connected to the crankcase portion 3 with the well 6 at one end or the other. In the drawings, the passage 7 communicates with the passage 15 but the sump could be turned through 180 degrees to bring the passage 8 and gallery 14 into communication with the passage 15. Thus the sump can be fitted in either configuration to suit the engine application and in each case, passage 15 in the crankcase communicates with the bottom of the sump well 6 so as to allow oil to be drawn from it by an oil pump (not shown).

The filter element 11 is provided in that oil suction passage 7, 8 which is in use, i.e. passage 7 in the drawings. As illustrated the filter element 11 is tapered and is inserted so that its larger end seats on the shoulder 10. The filter element 11 is trapped in place by the crankcase once the sump is connected to it.

An alternative arrangement of the filter element 11 is shown in FIGS. 5 and 6. The filter element 11 is located within the sump well 6 and is located on the floor of the well with one end in engagement with the opening 9 at the lower end of the oil suction passage 7, 8. The filter element 11 is located in the opening 9 at one end and in a hole 16 in a cast lug 17 at its other end. A pair of wire clips 18 are fitted to the filter to retain the filter element in place between the opening 9 and lug 17. A drain plug 12 is provided in the floor of the sump well.

Another alternative arrangement of the filter element is shown in FIGS. 7 and 8. The filter element 11 is inserted laterally into the sump through a drain plug opening 19 that is located at the bottom of one of the oil suction passages 8. The two oil suction passages 7, 8 are arranged on the transverse centre line 8—8 of the sump. The filter element extends across the floor of the sump well 6 and each end engages an opening 9 at the lower end of the oil suction passages 7 and 8. The drain plug 20 closes the opening 19 to hold the filter element in place. If necessary, one of the unused passages 7, 8 can be closed by a plug or insert to avoid air from being drawn from it into the filter element.

We claim:

1. An engine sump having an oil well with an upright side wall having an oil suction passage completely integrally cast thereon so as to extend vertically between a lower opening of the passage that communicates with the sump at its lower end adjacent the side wall and an upper opening of the passage facing towards a crankcase at a top end of the sump adjacent the side wall, thereby to communicate with a passage in said crankcase leading to an oil pump.

2. A sump as claimed in claim 1 in which the upper opening of said oil suction passage comprises an upwardly opening gallery formed in the top of said side wall along part of its length.

3. A sump as claimed in claim 1 in which a filter element is located on the floor of said oil well and communicates with the lower end of the oil suction passage.

4. A sump as claimed in claim 1 in which two oil suction passages are provided in side walls of the sump at opposite locations relative to a central point seen in plan view so that the sump can be rotated 180 degrees about this point from one fitting position to another relative to the crankshaft and a corresponding oil suction passage communicates with said passage in the crankcase in each fitting position.

5. A sump as claimed in claim 4 in which the two oil suction passages are located adjacent diagonally opposite corners of said oil well.

6. A sump as claimed in claim 4 in which the two oil suction passages are located on the transverse centre line of the sump on one side of said oil well.

7. A sump as claimed in claim 1 in which said oil suction passage is adapted to receive a filter element so that it is held therein by the crankcase.

8. A sump as claimed in claim 7 in which said oil suction passage tapers inwards from top to bottom and is formed with an internal shoulder on which the filter element is seated.

9. A sump as claimed in claim 8 in which said oil suction passage opens sideways into the sump through an opening in said side wall and said internal shoulder is located above said opening.

* * * * *